US005207935A

United States Patent [19]

Waynick

[11] Patent Number: 5,207,935

[45] Date of Patent: * May 4, 1993

[54] WHEEL BEARING GREASE

[75] Inventor: John A. Waynick, Wheaton, Ill.

[73] Assignee: Amoco Corporation, Chicago, Ill.

[ * ] Notice: The portion of the term of this patent subsequent to Nov. 29, 2005 has been disclaimed.

[21] Appl. No.: 864,592

[22] Filed: Apr. 7, 1992

Related U.S. Application Data

[63] Continuation-in-part of Ser. No. 738,264, Jul. 31, 1991, Pat. No. 5,158,694, which is a continuation-in-part of Ser. No. 590,482, Sep. 28, 1990, Pat. No. 5,096,605, which is a continuation-in-part of Ser. No. 332,509, Mar. 31, 1989, Pat. No. 5,000,862.

[51] Int. Cl.[5] ..... C10M 117/00; C10M 125/10

[52] U.S. Cl. ..... 252/18; 252/25; 252/49.6; 252/33.3

[58] Field of Search ..... 252/18, 25, 49.6, 11

[56] References Cited

U.S. PATENT DOCUMENTS

| | | | |
|---|---|---|---|
| 4,305,831 | 12/1981 | Johnson, III et al. | 252/18 |
| 4,749,502 | 6/1988 | Alexander et al. | 252/35 |
| 4,830,767 | 5/1989 | Waynick | 252/25 |
| 4,929,371 | 5/1990 | Waynick | 252/25 |
| 5,096,605 | 3/1992 | Waynick | 252/18 |
| 5,102,565 | 4/1992 | Waynick | 252/18 |

*Primary Examiner*—Jacqueline Howard

*Attorney, Agent, or Firm*—James R. Henes; Richard A. Kretchmer; Frank J. Sroka

[57] ABSTRACT

An improved smoother extreme pressure wear-resistant wheel bearing grease provides high temperature bearing life. These qualities are attributable to a special combination of additives blended in the greases, including: succinate, sulfonate, phosphate, carbonate, and sodium nitrite.

19 Claims, No Drawings

WHEEL BEARING GREASE

CROSS REFERENCE TO RELATED APPLICATIONS

This patent application is a continuation-in-part of the patent application of John Andrew Waynick, Ser. No. 07/738,264 filed Jul. 31, 1991, U.S. Pat. No. 5,158,694 entitled "Railroad Grease," which is a continuation-in-part of the patent application of John Andrew Waynick, U.S. Pat. No. 5,096,605, issued Mar. 17, 1992, Ser. No. 07/590,482, filed Sept. 28, 1990, entitled "Aluminum Soap Thickened Steel Mill Grease" which is a continuation-in-part of John Andrew Waynick, U.S. Pat. No. 5,000,862, issued Mar. 19, 1991, Ser. No. 07/332,509, filed Mar. 31, 1989, entitled "Process for Protecting Bearings in Steel Mills and Other Metal Processing Mills.".

BACKGROUND OF THE INVENTION

This invention pertains to lubricants and, more particularly, to a grease particularly effective for lubrication of automotive bearings.

Lubrication of wheel bearings has been practiced almost since bearings were used to promote efficient rotational motion of wheels. In older cars, wheel bearings were periodically removed, cleaned to remove old grease and any contaminants, and repacked with new grease. The performance requirements of such automotive wheel bearing greases were much less since relubrication occurred at regular intervals.

In recent years however, there has been a switch to sealed-for-life automotive wheel bearings. The grease used in these bearings must provide all the lubrication requirements for the entire life of the bearing. Since most automotive manufacturers want these wheel bearings to last for the entire life of the car, this places an enormously increased demand on the grease. Also, recent changes in bearing and drive train design have further increased grease performance requirements by sometimes increasing the internal loading of the bearings beyond the purely hydrodynamic or elastohydrodynamic regime previously experienced. The result of these changes is that wheel bearing grease used in older vehicles may not be satisfactory for outstanding performance in today's vehicles. Also, many automotive manufacturers want a wheel bearing grease which will also perform well in other automotive bearing applications such as alternator bearings, water pump bearings, and air conditioner compressor bearings.

Greases which offer truly outstanding performance in today's automotive wheel bearings must simultaneously meet numerous performance criteria. The most important property needed by a high performance automotive wheel bearing grease is long bearing life. The grease must protect the bearings for long periods of time at sustained temperatures which can reach 350° F. or higher. Perhaps the best measure of this performance attribute is the high temperature bearing test, ASTM D3336, especially when run at 350° F. ASTM D3336, bearing life at 350° F. has been mostly limited to 600 hours to 800 hours in prior art greases. Superior performance is sought. Specifically, ASTM D3336 bearing lives at 350° F. of at least 1,000 hours are desired to assure outstanding performance.

To obtain such improved ASTM D3336 performance requires improvements in many other performance-related properties. The grease must exhibit a high dropping point, at least 450° F. The grease must exhibit reduced oil separation, especially at high temperatures such as 300° F. to 350° F. Excellent oxidation and thermal stability is needed. A minor amount of extreme pressure (EP) and antiwear (AW) performance is needed, especially to reflect some of the more modern design changes in today's automotive wheel bearings. This requirement is, however, belied by the fact that traditional EP/AW additives are extremely deleterious to high temperature bearing life. For instance, inclusion of organo-sulfur EP/AW additives are well known to reduce ASTM D3336 bearing life at 350° F. by 80% or more, even when such additives are present in small to moderate levels. While this phenomenon is not well understood, one theory is that the traditional EP/AW additives accelerate corrosive fatigue of the bearings due to their well known high temperature corrosivity. Therefore, in a high performance automotive wheel bearing grease, any EP/AW properties must be provided while maintaining excellent non-corrosivity at high temperatures.

Besides those properties contributing to excellent high temperature bearing life, other properties required by high performance automotive wheel bearing greases include excellent corrosion (rust) protection, even in the presence of salt water.

A high performance automotive wheel bearing grease should also provide excellent fretting wear protection at low temperature. This property stems from the shipment of finished cars by truck over cold mountainous terrain. Under such transport, the wheels will "jiggle" for many hours. This oscillatory motion is further complicated by the low temperatures which can be experienced. Prior art wheel bearing greases have been used which provided less than adequate protection against such conditions. The result was cars arriving at their shipping destination with high levels of fretting wear in he wheel bearings.

Yet another property required by high performance automotive wheel bearing greases is minimal high temperature outgassing. The grease should not generate large quantities of gaseous products when held at high temperatures. This is because the wheel bearing is sealed by an elastomer to minimize environmental contamination. Any gaseous products given off by the grease at high temperatures will put a stress on the seal and in extreme cases cause the seal to pop or break. Some automotive bearing seals have vent holes to prevent this from occurring, but unfortunately not all seals have this design safeguard. One large American automotive manufacturer has specified that wheel bearing greases must not produce in excess of 28 pounds per square inch (psi) of outgassing pressure at 350° F. and no more than 5 psi after the grease has cooled to 75° F. The test method used in this determination is described in a subsequent example.

Yet another desired property of high performance automotive wheel bearing greases is that they contribute minimally to bearing noise during bearing operation. Such greases are often referred to as quiet greases. Surprisingly, it has been found that all greases contribute to noise during bearing operation. However, not all greases contribute equally to the noise. The reason that the acoustic properties of a wheel bearing grease are important has to do with bearing manufacturing quality control. One effective, efficient, and economical way to determine if newly manufactured bearings have manufacturing flaws is to determine their acoustical properties during use. If the grease in them is too noisy, it may mask the characteristic acoustical properties which would otherwise tell the quality control technician whether the bearing is or is not flawed. A grease will tend to be more quiet if it possesses a smooth texture. Experience with two recent wheel bearing greases indicated that the one which was significantly quieter also possessed an extremely smooth texture and a semi-translucent, glassy appearance. The other wheel bearing grease had a less smooth texture and an opaque, waxy appearance.

Over the years, a variety of lubricants have been used and suggested for use to lubricate automotive wheel bearings. These compositions have met with varying degrees of success, since they are usually deficient in one or more of the above categories and do not possess all the above mentioned desirable qualities.

It is therefore, desirable to provide an improved automotive wheel bearing grease which overcomes many, if not all, of the preceding problems.

SUMMARY OF THE INVENTION

An improved automotive wheel bearing grease is provided which is particularly useful in automotive wheel bearings for use in: cars, jeeps, trucks, vans, trailers, mobile homes road grading equipment, tractors and agricultural equipment, motorcycles, bicycles, and other vehicles. It can also be used with success in other bearing applications such as for use in alternators, water pumps and air conditioners.

Advantageously, the novel grease provides excellent high temperature bearing life as indicated by ASTM D3336 test results. It has excellent oil separation properties at temperatures as high as 350° F. It also has a dropping point greater than 450° F. The improved automotive wheel bearing grease has a moderate level of extreme pressure (EP) and antiwear (AW) performance without sacrificing any high temperature bearing life.

Desirably, the novel grease is extremely non-corrosive to copper and steel even at temperatures of 350° F. Other attributes of the improved automotive wheel bearing grease include excellent corrosion (rust) protection, even in the presence of salt water, excellent low temperature fretting wear protection, an extremely smooth texture and a pleasing semi-translucent, glassy appearance.

The novel lubricating grease has: (a) a substantial proportion of a base oil, (b) a thickener, such a polyurea, triurea, or biurea, or combinations thereof, and (c) a sufficient amount of an additive package to impart excellent high temperature bearing life. Desirably, the synergistic combination of compounds in the inventive lubricating grease also provides the following qualities: low oil separation properties, excellent oxidative and thermal stability, sufficient EP/AW properties, non-corrosivity to ferrous and non-ferrous metals at high temperatures, good corrosion (rust) protection in the presence of salt water, minimal high temperature outgassing characteristics, and smooth texture conducive to good acoustic properties.

The additive package contains, as more fully described below, (a) an extreme pressure wear resistant (antiwear) phosphate/carbonate system, (b) an oil soluble or oil dispersible antioxidant, (c) a texture smoothing corrosion (rust) inhibitor sulfonate/succinate system, (d) a relatively minor amount of sodium nitrite to provide with component (c) a synergistic improvement in high temperature bearing life beyond that which is characteristic of prior art automotive wheel bearing greases.

In one form, the extreme pressure antiwear (wear-resistant) additive package comprises tricalcium phosphate in the absence of sulfur compounds, especially oil-soluble sulfur compounds. Tricalcium phosphate provides many unexpected advantages over monocalcium phosphate and dicalcium phosphate. For example, tricalcium phosphate is water-insoluble and will not be extracted from the grease if contacted with water. Tricalcium phosphate is also very nonreactive and non-corrosive to ferrous and nonferrous metals even at very high temperatures. It is also nonreactive and compatible with most if not all of the elastomers in which lubricants may contact.

On the other hand, monocalcium phosphate and dicalcium phosphate are water-soluble. When water comes into significant contact with monocalcium or dicalcium phosphate, they have a tendency to leach, run, extract, and wash out of the grease. This destroys any significant antiwear and extreme pressure qualities of the grease. Monocalcium phosphate and dicalcium phosphate are also protonated and have acidic hydrogen present which can at high temperature adversely react and corrode ferrous and nonferrous metals as well as degrade many elastomers. In another form, the extreme pressure antiwear additive package comprises carbonates and phosphates together preferably in the absence of sulfur compounds including oil-soluble sulfur compounds and insoluble arylene sulfide polymers. The carbonates and phosphates are of a Group 2a alkaline earth metal, such as beryllium, magnesium, calcium, strontium, and barium, or of a Group 1a alkali metal, such as lithium, sodium, potassium, rubidium, cesium, and francium. Calcium carbonate and tricalcium phosphate are preferred for best results because they are economical, stable, nontoxic, water-insoluble, and safe.

The use of both carbonates and phosphates in the additive package produced unexpected surprisingly good results over the use of greater amounts of either carbonates alone or phosphates alone. For example, the use of both carbonates and phosphates produced superior wear protection in comparison to a similar grease with a greater amount of carbonates in the absence of phosphates, or a similar grease with a greater amount of phosphates in the absence of carbonates. Furthermore, the synergistic combination of calcium carbonate and tricalcium phosphate can reduce the total additive level over a single additive and still maintain superior performance over a single additive.

The non-corrosivity of the mixture of phosphates and carbonates at very high temperatures is also in marked contrast to oil-soluble sulfur-containing materials. The use of sulfur compounds, such as oil soluble sulfur-containing compounds, should generally be avoided in the additive package of automotive wheel bearing greases because they are chemically corrosive and detrimental to the metal bearing surface at the high temperatures often encountered in automotive wheel bearings. Oil soluble sulfur compounds, by virtue of their corrosive nature, may under high temperature, repetitive mechanical stress (loading) conditions accelerate the onset of metal fatigue failure. If this process occurs during the long-term use of an automotive wheel bearing, the result could be premature bearing failure.

The antioxidant portion of the additive package comprises one or more members from the so-called amine or phenolic antioxidants, with the amine type being preferred.

The term "phenolic antioxidant" is to be understood in this application to refer to oxygen-containing aromatic compounds, specifically those compounds commonly known as partially or fully hindered phenols. Compounds included in this group include but are not limited to 1-methyl 6-tertiary butyl phenol, 1,4-dimethyl 6-tertiary butyl phenol, 1,6-di-tertiary butyl phenol, and 1,6-di-tertiary butyl 4-methyl phenol. More complex compounds in which more than one of the hindered phenol groups are connected by alkylene bridging groups are also known to be effective as antioxidants.

The term "amine antioxidant" is to be understood in this application to refer to substantially ashless, nitrogen-containing materials used to prevent, retard, or reduce oxidation of base oil and other grease components. While this group of antioxidants comprises compounds with amine groups; it also comprises other nitrogen-containing species as well. Preferred within this amine group are the ashless antioxidants (those which contain no metal atoms). Some of these antioxidants include phenyl-alpha-naphthyl amine, bis(alkylphenyl-)amine, N,N- diphenyl-p-phenylene-diamine, 2,2,4-trimethyldihydroquinoline oligomer, bis(4-isopropylaminophenyl)-ether, N-acyl-p-aminophenol, N-acylphenothiazines, N-hydrocarbylamides of ethylenediamine tetraacetic acid, and alkylphenol-formaldehyde-amine polycondensates. Also included are diphenylamine, phenylenediamine, and their respective alkylated and/or arylated homologs.

The corrosion (rust) inhibitor system portion of the additive package comprises a mixture or blend of oil soluble or oil dispersible metal salts of sulfonic acids (metal sulfonate salts) and succinic acids (metal succinate salts). Although this portion of the additive package is essentially responsible for the ferrous corrosion (rust) protection, it has been surprisingly and unexpectedly found that it also imparts a very smooth texture and semitranslucent, glassy appearance. When used with the phosphate/carbonate system described above, the sulfonate/succinate salt system promotes extreme homogenization of the phosphate and carbonate salts. Surprisingly, the presence of the sulfonate/succinate salt system in combination with the phosphate/carbonate system has also been unexpectedly found to further enhance the EP/AW properties of the grease, even though the sulfonate/succinate salt system has no significant EP/AW properties of its own.

Comparison of grease compositions containing corrosion inhibitor systems of only metal sulfonate salts, and grease compositions containing corrosion inhibitor systems containing both metal sulfonate and metal succinate salts, indicate that the texture modification is due to the succinate component and not to the sulfonate component.

The metals involved in the sulfonate/succinate corrosion (rust) inhibitor system are of a Group 2a alkaline earth metal, such as beryllium, magnesium, calcium, strontium, and barium, or of a Group 1a alkali metal, such as lithium, sodium, potassium, rubidium, cesium, and francium, or of a transition metal of the first, second, or third series.

The sulfonic acids involved in the sulfonate/succinate corrosion (rust) inhibitor system are selected from the group of petroleum sulfonic acids, alkylbenzene sulfonic acids, or alkylnaphthylene sulfonic acids. Sulfonic acids containing higher order aromatic ring structures such as anthracene or phenalene may also be used, along with alkylated homologs of the same. The succinic acids involved in the sulfonate/succinate corrosion (rust) inhibitor system are selected from succinic acid and the alkylated succinic acids. A commonly used one is dodecenylsuccinic acid (tetrapropenylsuccinic acid).

The additive package of the automotive wheel bearing grease also comprises a minor portion of sodium nitrite. Sodium nitrite has been used for many years in lubricants as a ferrous corrosion (rust) inhibitor. However, it has been surprisingly and unexpectedly found that the inclusion of a minor portion of sodium nitrite into the grease composition greatly increases the high temperature bearing life as measured by ASTM D3336. This effect is especially pronounced when the sodium nitrite is present with the sulfonate/succinate metal salt portion of the additive package as described above.

The novel grease may be further augmented in its composition by a boron-containing material to further inhibit oil separation. Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company.

Other useful borates include borates of Group 1a alkali metals, borates of Group 2a alkaline earth metals, stable borates of transition metals (elements), such as zinc, copper, and tin, boric oxide, and combinations of the above.

Polymer additives may also be added to modify the tackiness of the grease and further reduce oil separation. Polymeric additive can comprise: polyesters, polyamides, polyurethanes, polyoxides, polyamines, polyacrylamides, polyvinyl alcohol, ethylene vinyl acetate, or polyvinyl pyrrolidone; polyolefins (polyalkylenes), such as polyethylene, polypropylene, polyisobutylene, ethylene propylene, and ethylene butylene; or polyolefin (polyalkylene) arylenes, such as polymers of ethylene styrene and styrene isoprene; polyarylene polymers such as polystyrene; polyacrylate, or polymethacrylate; or combinations, or boronated analogs (compounds) of the preceding. Preferably, the polymeric additive comprises: polyolefins (polyalkylenes), such as polyethylene, polypropylene, polyisobutylene, ethylene propylene, and ethylene butylene; or polyolefin (polyalkylene) arylenes, such as ethylene styrene and styrene isoprene; polyarylene polymers such as polystyrene.

As used in this application, the term "polymer" means a molecule comprising one or more types of monomeric units chemically bonded together to provide a molecule with at least six total monomeric units. The monomeric units incorporated within the polymer may or may not be the same. If more than one type of monomer unit is present in the polymer the resulting molecule may be also referred to as a copolymer.

A more detailed explanation of the invention is provided in the following description and appended claims.

DETAILED DESCRIPTION OF THE PREFERRED EMBODIMENT

A high performance automotive wheel bearing grease is provided which effectively lubricates the bearings and provides improved benefits as described above.

The novel grease has the following qualities: imparts long high temperature bearing life to sealed-for-life automotive wheel bearings, exhibits low oil separation even at high temperatures, provides the needed levels of extreme pressure and wear resistance, maintains non-corrosivity to ferrous and non-ferrous metals even at prolonged high temperatures, provides excellent rust protection even in the presence of salt water, protects against fretting wear at low temperatures, provides acceptably low levels of high temperature outgassing, imparts a very smooth grease texture and appearance conducive to superior acoustical properties. Furthermore, the novel grease also extends the level of the above mentioned performance properties beyond that exhibited by prior art greases.

The novel automotive wheel bearing grease comprises by weight: 20% to 95% base oil, 0.1% to 30% thickener, 0.02% to 10% extreme pressure antiwear additives, 0.1% to 10% antioxidant, 0.1% to 10% rust inhibitor, and 0.01% to 5% sodium nitrite. The preferred lubricating grease comprises by weight: 45% to 85% base oil, 4% to 20% thickener, 0.2% to 5% extreme pressure antiwear additives, 0.5% to 5% antioxidant, 0.5% to 5% rust inhibitor, and 0.05% to 2% sodium nitrite. For best results, the most preferred automotive wheel bearing grease comprises by weight: at least 65% base oil, 8% to 14% thickener, 1% to 2% extreme pressure antiwear additives, 1% to 2.5% antioxidant, 1% to 2.5% rust inhibitor, and 0.1% to 1% sodium nitrite.

Sulfide polymers, such as insoluble arylene sulfide polymers, should be avoided in the grease because they: (1) corrode copper, steel, and other metals, especially at high temperatures, (2) degrade, deform, and corrode silicon seals, (3) significantly diminish the tensile strength and elastomeric properties of many elastomers, (4) exhibit inferior fretting wear, and (5) are abrasive.

Sulfur compounds, such as oil-soluble sulfur compounds, can be even more aggravating, troublesome, and worse than oil-insoluble sulfur compounds. Sulfur compounds and especially oil soluble sulfur compounds should be generally avoided in the grease because they are often chemically incompatible and detrimental to silicone, polyester, and other types of elastomers and seals. Oil-soluble sulfur compounds can destroy, degrade, deform, chemically corrode, or otherwise damage elastomers and seals by significantly diminishing their tensile strength and elasticity.

Furthermore, oil-soluble sulfur compounds are extremely corrosive to copper, steel and other metals at high temperatures such as 350° F.

Generally, any sulfur-containing organic compounds should be avoided in the additive composition of the wheel bearing grease, especially the sulfurized hydrocarbons and organometallic sulfur salts. Sulfur compounds of the type to be avoided in the grease include saturated and unsaturated aliphatic as well as aromatic derivatives that have from 1 to 32 or 1 to 22 carbon atoms. Included in this group of oil soluble sulfur compounds to be avoided in the grease are alkyl sulfides and alkyl polysulfides, aromatic sulfides and aromatic polysulfides, e.g. benzyl sulfide and dibenzyl disulfide, organometallic salts of sulfur containing acids such as the metal neutralized salts of dialkyl dithiophosphoric acid, e.g. zinc dialkyl dithiophosphate, as well as phosphosulfurized hydrocarbons and sulfurized oils and fats. Sulfurized and phosphosulfurized products of polyolefins are very detrimental and should be avoided in the grease. A particularly detrimental group of sulfurized olefins or polyolefins are those prepared from aliphatic or terpenic olefins having a total of 10 to 32 carbon atoms in the molecule and such materials are generally sulfurized such that they contain from about 10 to about 60 weight percent sulfur.

Sulfurized aliphatic olefins to be avoided in the grease include sulfurized mixed olefins in which the original olefins were materials such as cracked wax, cracked petrolatum or single olefins such as tridecene-2, octadecene-1, eikosene-1 as well as polymers of aliphatic olefins having from 2 to 5 carbon atoms per monomer such as ethylene, propylene, butylene, isobutylene and pentene.

The sulfurized terpenic olefins to be avoided in the grease include sulfurized terpenic olefins in which the original olefins were materials such as terpenes ($C_{10}H_{16}$), sesquiterpenes ($C_{15}H_{24}$) and diterpenes ($C_{20}H_{32}$). Of the terpenes, the monocyclic terpenes having the general formula $C_{10}H_{16}$ and their monocyclic isomers are particularly detrimental.

Base Oil

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl)siloxane, and poly(methyl)phenylsiloxane.

The preferred base oil comprises about 60% by weight of a refined, solvent-extracted, hydrogenated, dewaxed base oil, preferably 850 SUS oil, and about 35% by weight of another refined solvent-extracted dewaxed base oil, preferably 350 SUS oil, for better results.

Thickener

Thickeners useful in the novel lubricating grease include polyurea. Polyurea thickeners are preferred over other types of thickeners because they have high dropping points, typically 460° F. to 500° F., or higher. Polyurea thickeners are also advantageous because they have inherent antioxidant characteristics, work well with other antioxidants, and are compatible with all elastomers and seals.

The polyurea thickener can be prepared, if desired, by reacting an amine and a polyamine, with diisocyanate. For example, polyurea can be prepared by reacting the following components:

1. A diisocyanate or mixture of diisocyanates having the formula OCN-R-NCO, wherein R is a hydrocarbylene having from 2 to 30 carbons, preferably from 6 to 15 carbons, and most preferably 7 carbons;

2. A polyamine or mixture of polyamines having a total of 2 to 40 carbons and having the formula:

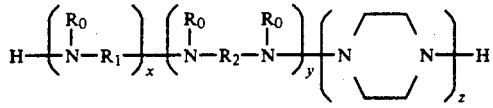

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 or 0 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The reaction is usually accomplished in a suitable solvent. In most cases the solvent is a portion of the base oil to be used in the final lubricating grease. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

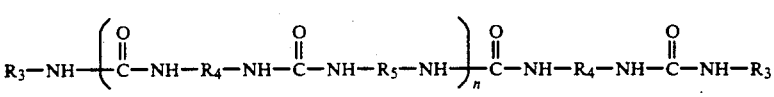

(1)

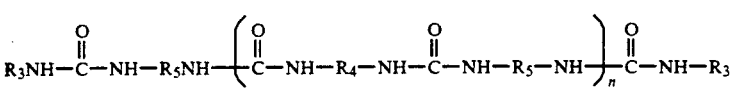

(2)

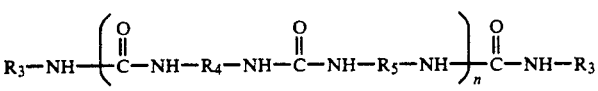

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar parts of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyanate, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

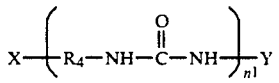

(4)

wherein $n^1$ is an integer of 1 to 3, $R_4$ is defined supra; X and Y are monovalent radicals selected from Table 1 below:

TABLE 1

| X | Y |
|---|---|
| $R_7-C(=O)-NH-$ | $R_7-C(=O)-NH-R_5-$ |
| 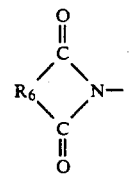 | 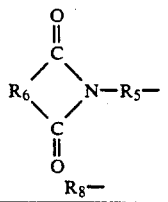 |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially. Usually, the reactants are mixed and reacted in a solvent to assist in facilitating a complete reaction to form the desired polyurea thickener. The solvent can, in principle, be any solvent which allows effective dispersion and mixing of the reactants as well as dispersion of the resulting polyurea. However, in most cases the solvent used is a portion of the base oil to be part of the final lubricating grease.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

The polyurea comprising the thickener can also be prepared in a pot, kettle, bin, or other vessel by reacting an amine, such as a fatty amine, with diisocyanate, or a polymerized diisocyanate, and water. In this case the polyamine (diamine in this case) is formed in situ by hydrolysis of the diisocyanate. Therefore, the chemical structure of the polyamine will be determined by the choice of diisocyanate used. When this reaction scheme is used to form the polyurea, the diisocyanates and amines useful are the same as those already given above. As already described, the reaction to form the polyurea usually takes place in a solvent. The solvent is usually a portion of the base oil to be used in the final lubricating grease.

Biurea (diurea) may be used as a thickener, but it is generally not as stable as polyurea and may shear and lose consistency when pumped. If desired, triurea can also be included with or used in lieu of polyurea or biurea.

Extreme Pressure Antiwear Additives

In order to attain extreme pressure (EP) properties, antiwear (AW) qualities, maintain high temperature non-corrosivity, as well as any elastomeric compatibility, the additives in the additive package comprise, in one form, tricalcium phosphate and calcium carbonate, preferably in the absence of sulfur compounds for best results.

The tricalcium phosphate and the calcium carbonate are each present in the additive package in an amount ranging from 0.01% to 5% by weight of the grease. Preferably, the tricalcium phosphate and the calcium carbonate are each present in the additive package in an amount ranging from 0.1% to 2.5% by weight of the grease. Most preferably for best results, the tricalcium phosphate and calcium carbonate are each present in the additive package in an mount ranging from 0.5% to 1% by weight of the grease.

Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)2$ or $3Ca_3(PO_4)_2.Ca(OH)_2$.

If desired, the calcium carbonate and/or tricalcium phosphate can be added, formed, or created in situ in the grease as by-products of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is preferred, other phosphate additives can be used, if desired, in conjunction with or in lieu of tricalcium phosphate, such as the phosphates of a Group 2*a* alkaline earth metal, such as beryllium, magnesium, calcium, strontium, and barium, or the phosphates of a Group 1*a* alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be noncorrosive to metals and compatible with elastomers and seals. Tricalcium phosphate is also water-insoluble and will not wash out of the grease when contamination by water occurs. Monocalcium phosphate and dicalcium phosphate, however, have acidic protons which at high temperatures can corrosively attack metal surfaces. Monocalcium phosphate and dicalcium phosphate were also found to corrode, crack, and/or degrade some elastomers and seals. Monocalcium phosphate and dicalcium phosphate were also undesirably found to be water soluble and can wash out of the grease when exposed to water, which would significantly decrease the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of Group 2*a* alkaline earth metal, such as beryllium, magnesium, calcium, strontium, and barium, or the carbonates of a Group 1*a* alkali metal, such as lithium, sodium, and potassium.

Desirably, calcium carbonate is less expensive, less toxic, more readily available, safer, and more stable than other carbonates. Calcium carbonate is also superior to calcium bicarbonate. Calcium carbonate has been unexpectedly found to be non-corrosive to metals and compatible to elastomers and seals. Calcium carbonate is also water insoluble. Calcium bicarbonate, however, has an acidic proton which at high temperatures can corrosively attack metal surfaces. Also, calcium bicarbonate has been found to corrode, crack, and/or degrade many elastomers and seals. Calcium bicarbonate has also been undesirably found to be water soluble and experiences many of the same problems as monocalcium phosphate and dicalcium phosphate discussed above.

The use of both tricalcium phosphate and calcium carbonate together in the extreme pressure antiwear (wear-resistant) additive package of the novel grease was found to produce unexpected superior results.

Antioxidants

Antioxidants are additives used to prevent, retard, or reduce oxidation of the base oil and other grease components and other oxidizable components of the lubricant. Antioxidants useful in the additive package of the novel automotive wheel bearing grease comprise one or more members from the so-called amine or phenolic antioxidants, with the amine type being preferred.

The term "phenolic antioxidant" is to be understood in this application to refer to oxygen-containing aromatic compounds, specifically those compounds commonly known as partially or fully hindered phenols. Compounds included in this group include derivatives of phenol in which the 2 and/or 6 position is alkylated. The alkyl groups on at least one of the ortho positions should be a steric hindering group such as a tertiary butyl. Additional alkyl groups on other positions of the phenol ring may also exist. Examples of such compounds include 1-methyl 6-tertiary butyl phenol, 1,4-dimethyl 6-tertiary butyl phenol, 1,6-di-tertiary butyl phenol, and 1,6-di-tertiary butyl 4-methyl phenol. More complex compounds in which more than one of the hindered phenol groups are connected by alkylene bridging groups are also known to be effective as antioxidants.

Preferred antioxidants are those comprising one or more members selected from the group known as amine antioxidants. The term "amine antioxidant" is to be understood in this application to refer to ashless, nitrogen-containing materials used to prevent, retard, or reduce oxidation of the base oil and other grease components. While this group of antioxidants contains compounds with amine groups, it also includes other nitrogen-containing species as well. Preferred within this amine group are the ashless antioxidants (those which contain no metal atoms). Some of these antioxidants include phenyl-alpha-naphthyl amine, bis(alkyphenyl)amine, N,N-diphenyl-p-phenylenediamine, 2,2,4-trimethyldihydroquinoline oligomer, bis(r-isopropylaminophenyl)-ether, N-acyl-p-aminophenol, N-acylphenothiazines, N-hydrocarbylamdies of ethylenediamine tetraacetic acid, and alkylphenol-formaldehyde-amine polycondensates. Most preferred are the antioxidants comprising one or more members selected from the group including diphenylamine, phenylenediamine, and their respective alkylated and/or arylated homologs. Especially preferred within this most preferred group is: Irganox L-57, manufactured by Ciba-Geigy Corporation; Vanlube 848 and Vanlube 849, manufactured by R. T. Vanderbilt Company, Inc.; and Additin 35, manufactured by Rhein-Chemie Corporation.

Rust Inhibitors

Rust (ferrous corrosion) inhibitors are those additives used in lubricants to prevent, retard, or reduce the formation of rust on lubricated metal surfaces which are also exposed to water. The rust (ferrous corrosion)

inhibitor system portion of the additive package comprises a mixture or blend of oil soluble or oil dispersible metal salts of sulfonic acids (metal sulfonate salts) and succinic acids (metal succinate salts). Although this portion of the additive package is essentially responsible for the rust protection, it has been surprisingly and unexpectedly found that it also imparts to the grease a very smooth texture and semi-translucent, glassy appearance. When used with the phosphate/carbonate system described above, the sulfonate/succinate salt system promotes extreme homogenization of the phosphate and carbonate salts. The presence of the sulfonate/succinate salt system in combination with the phosphate/carbonate system has also been surprisingly and unexpectedly found to further enhance the EP/AW properties of the grease, even though the sulfonate/succinate salt system has no significant EP/AW properties of its own.

Comparison of grease compositions containing corrosion inhibitor systems of only metal sulfonate salts, and grease compositions containing corrosion inhibitor systems containing both metal sulfonate and metal succinate salts, indicate that the texture modification is due to the succinate component and not to the sulfonate component.

The metals involved in the sulfonate/succinate rust inhibitor system are of a Group 2a alkaline earth metal, such as beryllium, magnesium, calcium, strontium, and barium, or of a Group 1a of alkali metal, such as lithium, sodium, potassium, rubidium, cesium, and francium, or of a transition metal of the first, second, or third series.

Preferably, the metals involved in the sulfonate/succinate rust inhibitor system are of a Group 2a alkaline earth metal, such as beryllium, magnesium, calcium, strontium, and barium, or the first row transition metals. Most preferably, the metals involved in the sulfonate/succinate rust inhibitor system comprise one or more of the members from the group of calcium, magnesium, barium, and zinc.

The sulfonic acids involved in the sulfonate/succinate rust inhibitor system are selected from the group of petroleum sulfonic acids, alkylbenzene sulfonic acids, and alkylnaphthylene sulfonic acids. Sulfonic acids containing higher order aromatic ring structures such as anthracene or phenalene may also be used, along with alkylated homologs of the same. Preferably, the sulfonic acids involved in the sulfonate/succinate rust inhibitor system are selected from the group of alkylbenzene sulfonic acids and alkylnaphthylene sulfonic acids. Most preferably, the sulfonic acids involved in the sulfonate/succinate rust inhibitor system are selected from the group of alkylnaphthylene sulfonic acids, with dinonylnaphthylene sulfonic acid being especially preferred.

The succinic acids involved in the sulfonate/succinate rust inhibitor system are selected from the alkylated succinic acids. The preferred succinic acids involved in the sulfonate/succinate rust inhibitor system are monoalkylated with the alkyl group having at least two carbons. The most preferred succinic acid involved in the sulfonate/succinate rust inhibitor system is dodecenylsuccinic acid (tetrapropenylsuccinic acid).

The sulfonate and succinate salts may be added separately or they may be added together as an already blended additive. The sulfonate and succinate salts may also be formed in situ in the grease during the grease manufacturing steps. For instance, the corresponding sulfonic acid and/or succinic acid may be reacted with a metal basic material. The reaction byproducts of water and/or carbon dioxide may be removed from the resulting grease by heat, vacuum, or both heat and vacuum. Other reaction schemes may also be used. The final grease properties will depend on the type of sulfonate and succinate salt used, not the method by which the sulfonate and succinate salts were introduced into the grease.

One especially preferred method of introduction of sulfonate and succinate salts into the automotive wheel bearing grease is to use one or more of several additives in which both sulfonate salt and succinate salt are already present. Such additives include the brand names Nasul BSN-Ht, Nasul CA-Ht, Nasul MG-HT, and Nasul ZN-HT, all manufactured by King Industries.

Sodium Nitrite

The additive package of the automotive wheel bearing grease also comprises sodium nitrite. Sodium nitrite has been used for many years in lubricants as a rust inhibitor. However, it has been surprisingly and unexpectedly found that the inclusion of a minor portion of sodium nitrite into the grease composition greatly increases the high temperature bearing life as measured by ASTM D3336. This effect is especially pronounced when the sodium nitrite is present with the sulfonate/succinate metal salt portion of the additive package as described above. Futhermore, it has been surprisingly and unexpectedly found that when the sulfonate/succinate salt portion of the additive package is used with the sodium nitrite, that the required amount of sodium nitrite for greatly increased high temperature bearing life is dramatically reduced.

In adding the sodium nitrite to the automotive wheel bearing grease, it has been found that the process used affects the high temperature outgassing properties of the resulting grease. When the sodium nitrite is added after the grease has cooled to about 200° F. or lower, the high temperature outgassing properties of the resulting grease are poor. If the sodium nitrite is added to a commercial batch f grease at 300° F., the resulting grease will have acceptable high temperature outgassing properties. The explanation for this is not well understood. It is well known that hydrogen nitrite (nitrous acid) decomposes at moderately elevated temperatures to give off gaseous nitrogen oxide, NO. Sodium nitrite, however, is reportedly much more stable, not decomposing until 608° F. Presumably, some interaction between sodium nitrite and some component of the polyurea base grease occurs which produces a gas. By adding the sodium nitrite to hot polyurea base grease and maintaining such elevated temperatures for the time typically necessary for cool down of commercial batches, further high temperature outgassing of the final desirable performance properties imparted by the sodium nitrite as described above are not altered or diminished by such processing conditions.

Polymers

Polymers may be added to the automotive wheel bearing grease to modify the texture and further restrict oil separation. A slight tacky texture may be preferred for esthetic reasons by some automotive wheel bearing manufactures and users. Highly tacky and adhesive textures should be avoided since such properties can adversely affect the high temperature bearing life of the resulting grease. Therefore, the level of polymers used in the automotive wheel bearing grease should be restricted. If used, polymers should not exceed 10% by weight of the grease. Preferably, polymers should not exceed 5% by weight of the grease. Most preferably, for best results, polymers, when used, should not exceed 1% by weight of the grease.

Polymers which are applicable for use in railroad track/wheel flange greases to attain the desired characteristics described above desirably have molecular weights in the range from about 1,000 to about 25,000,000 or more. Preferably, at least a substantial portion of polymer should have a molecular weight between 10,000 and 5,000,000. For best results, a substantial portion of the polymer should have a molecular weight between 50,000 and 200,000.

Acceptable polymers for attaining many of the grease characteristics described above include: polyolesters (polyesters), polyamides, polyurethanes, polyoxides, polyamines, polyacrylamide, polyvinyl alcohol, ethylene vinyl acetate copolymers and polyvinyl pyrrolidone copolymers. Other acceptable polymers include: polyolefins (polyalkylenes), such as polyethylene, polypropylene, polyisobutylene, ethylene propylene copolymers, or ethylene butylene copolymers; or polyolefin (polyalkylene) arylene copolymers, such as ethylene styrene copolymers and styrene isoprene copolymers; polyarylene polymers, such as polystyrene; acrylate or methacrylate polymers or copolymers. Copolymers with monomeric units comprising the monomeric units of the preceding polymers and combinations thereof may also be used. Also, boronated polymers or boronated compounds comprising the borated or boronated analogs of the preceding polymers (i.e., any of the preceding polymers reacted with boric acid, boric oxides, or boron inorganic oxygenated material) may also be used when nucleophilic sites are available for boration.

For better results, the preferred polymers include at least a substantial portion of a polymer containing as a monomeric unit an alkenyl substituted aryl group such as styrene.

For best results, the most preferred polymers include at least a substantial portion of a polymer containing as monomeric units an aryl substituted alkenyl group such as styrene as well as a non-aryl substituted alkenyl group such as ethylene, propylene, butene, butadiene, or isoprene. Particularly preferred among this group is the styrene-isoprene copolymer Shellvis 40, having a molecular weight of about 150,000 and sold by Shell Chemical Company.

Borates

In any of the above described forms of the novel lubricating grease, boron-containing oil separation inhibitors can be optionally added. It was found that borates or boron-containing materials such as borated amine, when used in polyurea greases in the presence of calcium phosphates and calcium carbonates, act as an oil separation inhibitor, which is especially useful at high temperatures.

Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company.

Other useful borates include borates of Group 1a alkali metals, borates of Group 2a alkaline earth metals, stable borates of transition metals (elements), such as zinc, copper, and tin, boric oxide, and combinations of the above.

When boron-containing oil separation inhibitors are used in the novel grease they should be present at 0.01% to 10%, preferably 0.1% to 5%, and most preferably 0.25% to 2.5%, by weight of the boron-containing material in the total grease.

It was also found that borated inhibitors minimized oil separation even when temperatures were increased from 210° F. to 300° F. or 350° F. Advantageously, borated inhibitors restrict oil separation over a wide temperature range. This is in direct contrast to the traditional oil separation inhibitors, such as high molecular weight polymer inhibitors such as that sold under the brand name of Paratac by Exxon Chemical Company U.S.A. As already discussed above, polymeric additives can impart an adhesive, stringy, or tacky texture to the lubricating grease because of the extremely high viscosity and long length of their molecules. As the temperature of the grease is raised, the viscosity of the polymeric additive within the grease is substantially reduced as is its tackiness. Tackiness restricts oil bleed. As the tackiness is reduced, the beneficial effect on oil separation is also reduced. Borated amine additives do not behave in this way since their effectiveness does not depend on imparted tackiness. Borated amines do not cause the lubricating grease to become adhesive, tacky, or stringy. This is desirable since it provides the lubricant formulator with the means to separately control the high temperature oil separation properties and the adhesive, tacky texture.

It is believed that borated amines chemically interact with the tricalcium phosphate and/or calcium carbonate in the grease. The resulting species then interacts with the polyurea thickener system in the grease to form an intricate, complex system which effectively binds the lubricating oil.

Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines.

The following Examples are for purposes of illustrating the novel automotive wheel bearing greases and should not be used for purposes of limiting the scope of the invention as provided in the appended claims.

EXAMPLE 1

A polyurea base grease was prepared in the following manner. To a laboratory grease kettle was charged 34.00 pounds of a solvent-extracted, hydrotreated, paraffinic mineral oil having a viscosity of about 850 SUS at 100° F. The oil was stirred and heated until the temperature reached 170° F. Then 7.49 pounds of fatty amine sold under the brand name of Armeen T by Akzo Chemicals, Inc. was added to the kettle where it melted and mixed well with the 850 SUS oil. Then 3,500 milliliters of water was added to the kettle and the contents stirred well while heating back to 170° F. A 8.51 pound charge of Isonate 143L, a diisocyanate blend sold by Dow Chemical Company and containing 4,4'-diphenylmethane diisocyanate, was added and the kettle was closed.

The contents of the kettle were stirred for 90 minutes while maintaining the temperature around 190° F. The hot heat transfer fluid was circulated through the kettle jacket to provide heating to the kettle contents. The polyurea base grease in the kettle was heated to 307° F. under sealed and pressurized conditions. During the heating step, the internal pressure was partially vented several times to maintain a pressure of 75 to 82 psi. Venting was accomplished via a valved port in the top of the kettle lid. When 307° F. was reached, the pressure was vented to atmospheric and the kettle was opened. During final venting, the temperature of the grease dropped to 230° F.

Upon inspection, the grease appeared to still contain some water, so the kettle was closed and the contents were heated under vacuum back to 309° F. The vacuum was then released, the kettle was opened, and 25.00 pounds were removed and stored for other uses. The remaining polyurea base grease was heated to 395° F. while maintaining a nitrogen blanket over it. During this heating step, 11.37 pounds of a solvent-extracted, hydrotreated, paraffinic mineral oil having a viscosity of 350 SUS at 100° F. was slowly added to base grease while continually stirring. The polyurea base grease was held at 395° F. for 15 minutes, cooled to 200° F., and removed and stored for later use. The final composition of the polyurea base grease was:

| Component | % (wt) |
|---|---|
| 850 SUS Oil | 46.74 |
| 350 SUS Oil | 31.26 |
| Polyurea | 22.00 |

EXAMPLE 2

To a laboratory grease kettle was charged 27.2 pounds of 850 SUS oil similar to that used in Example 1. After stirring and heating the oil to 170° F., 5.99 pounds of Armeen T (fatty amine) was added. When the Armeen T had melted and dissolved, 3,000 ml of water was added and allowed to mix with stirring while cooling the kettle contents to 120° F. Cooling was accomplished by circulating cold heat transfer fluid through the kettle jacket. When the temperature reached 120° F., 6.81 pounds of Isonate 143L, a diisocyanate blend sold by Dow Chemical Company and containing 4,4'-diphenylmethane diisocyanate were added to the kettle and allowed to mix without additional heating for 30 minutes. During this time a heavy grease like structure quickly formed.

The kettle was then closed and the grease was heated to 300° F. by circulation of hot heat exchange fluid through the kettle jacket. When the temperature of the kettle contents reached 300° F., the internal pressure was vented until atmospheric pressure was achieved. During the venting, the temperature of the polyurea base grease dropped to 256° F. Then a vacuum was pulled on the kettle and the contents were stirred for one hour while maintaining a temperature of about 250° F. to remove the remaining water. The kettle was then opened and 18.18 pounds of 850 SUS oil was slowly added to the dry, heavy polyurea base grease. One hour after all the oil had been added, polyurea base grease was removed and stored for later use. The final composition of the polyurea base grease was:

| Component | % (wt) |
|---|---|
| 850 SUS Oil | 78.00 |

-continued

| Component | % (wt) |
|---|---|
| Polyurea | 22.00 |

EXAMPLE 3

To a laboratory grease kettle was charged 30.8 pounds of 850 SUS oil similar to that used in Examples 1-2. After stirring and heating the oil to 180° F., 6.18 pounds of Armeen T was added. When the Armeen T (fatty amine) had melted and dissolved, 3,200 ml of water was added and allowed to mix with stirring while maintaining the temperature at 180° F. Temperature control was accomplished by circulating either hot or cold heat transfer fluid through the kettle jacket. When the water appeared well emulsified in the oil, 7.02 pounds of Mondur M, 4,4'-diphenylmethane diisocyanate sold by Mobay Chemical Corporation, was added to the kettle and allowed to mix without additional heating for 30 minutes. During this time a heavy grease-like structure quickly formed.

An additional 726.9 grams of 850 SUS oil was added to improve the ease of stirring of the heavy polyurea base grease. The kettle was then closed and the grease was heated to 300° F. by circulation of hot heat exchange fluid through the kettle jacket. When the temperature of the kettle contents reached 300° F., the internal pressure was vented until atmospheric pressure was attained. During the venting, the temperature of the polyurea base grease dropped to about 250° F. Then a vacuum was pulled on the kettle and the contents were stirred and heated back to 300° F. The vacuum was subsequently released, the kettle was opened, and 14.40 ponds of 859 SUS oil was slowly added to the dry, heavy polyurea base grease. Then the polyurea base grease was heated to 395° F. and held at that temperature for 15 minutes while continuing to stir. Then the polyurea base grease was cooled to 250° F., removed, and stored for later use. The final composition of the polyurea base grease was:

| Component | % (wt) |
|---|---|
| 850 SUS Oil | 78.00 |
| Polyurea | 22.00 |

The following Examples 4–14 illustrate the surprising and unexpected performance of tricalcium phosphate and calcium carbonate as an extreme pressure antiwear additive package.

EXAMPLE 4

This test served as the control for subsequent tests. A base grease was formulated with about 15% by weight polyurea thickener and about 85% by weight paraffinic solvent extracted base oil. The polyurea thickener was prepared in a vessel in a manner similar to Example 1. The paraffinic solvent extracted base oil was mixed with the polyurea thickener until a homogeneous base grease was obtained. No additive package was added to the base grease. Neither tricalcium phosphate nor calcium carbonate were present in the base grease. The EP (extreme pressure)/antiwear properties of the base grease, comprising the last nonseizure load, weld load, and load wear index were measured using the Four Ball EP method as described in ASTM D2596. The results were as follows:

Last nonseizure load, kg: 32
Weld load, kg: 100
Load wear index: 16.8

EXAMPLE 5

A grease was prepared in a manner similar to Example 4, except that about 5% by weight of finely divided, precipitated tricalcium phosphate with an average mean diameter of less than 2 microns was added to the base grease. The resultant mixture was mixed and milled in a roll mill until a homogeneous grease was produced. The Four Ball EP Test showed that the EP/antiwear properties of the grease were significantly increased with tricalcium phosphate.

Last nonseizure load, kg: 63
Weld load, kg: 160
Load wear index: 33.1

EXAMPLE 6

A grease was prepared in a manner similar to Example 5, except that about 10% by weight tricalcium phosphate was added to the base grease. The Four Ball EP Test showed that the EP/antiwear properties were further increased with more tricalcium phosphate.

Last nonseizure load, kg: 80
Weld load, kg: 250
Load wear index: 44.4

EXAMPLE 7

A grease was prepared in a manner similar to Example 6, except that about 20% by weight tricalcium phosphate was added to the base grease. The Four Ball EP Test showed that the EP/antiwear properties of the grease were somewhat better than the 5% tricalcium phosphate grease of Example 5, but not as good as the 10% tricalcium phosphate grease of Example 6.

Last nonseizure load, kg: 63
Weld load, kg: 250
Load wear index: 36.8

EXAMPLE 8

A grease was prepared in a manner similar to Example 4, except that about 5% by weight of finely divided precipitated tricalcium phosphate and about 5% by weight of finely divided calcium carbonate were added to the base grease. The tricalcium phosphate and calcium carbonate had an average mean particle diameter of less than 2 microns. The resultant grease was mixed and milled until it was homogeneous. The Four Ball EP Test showed that the EP/antiwear properties of the grease were surprisingly better than the base grease of Example 2 and the tricalcium phosphate greases of Examples 5-7.

Last nonseizure load, kg: 80
Weld load, kg: 400
Load wear index: 52.9

EXAMPLE 9

A grease was prepared in a manner similar to Example 8, except that 10% by weight tricalcium phosphate and 10% by weight calcium carbonate were added to the base grease. The Four Ball EP Test showed that the weld load was slightly lower and the load wear index was slightly better than the grease of Example 8.

Last nonseizure load, kg: 80
Weld load, kg: 315
Load wear index: 55.7

EXAMPLE 10

A grease was prepared in a manner similar to Example 9, except that 20% by weight tricalcium phosphate and 20% calcium carbonate were blended into the base grease. The Four Ball EP Test showed that the EP/antiwear properties of the grease were better than greases of Examples 8 and 9.

Last nonseizure load, kg: 100
Weld load, kg: 500
Load wear index: 85.6

EXAMPLE 11

A grease was prepared in a manner similar to Example 4, except that about 10% by weight of finely divided calcium carbonate with a mean particle diameter of less than 2 microns was added to the base grease. The resultant grease was mixed and milled until it was homogeneous. The Four Ball EP Test showed that the weld load and load wear index of the calcium carbonate grease were better than the base grease of Example 4.

Last nonseizure load, kg: 80
Weld load, kg: 400
Load wear index: 57

EXAMPLE 12

A grease was prepared in a manner similar to Example 8, except that about 3% by weight tricalcium phosphate and about 5% by weight calcium carbonate were added to the base grease. The Four Ball EP Test showed that the weld load and load wear index of the grease were better than the greases of Example 6 (10% tricalcium phosphate alone) and Example 11 (10% calcium carbonate alone), even though the total combined level of additives was only 8%. This result is most surprising and unexpected. It illustrates how the two additives can work together to give the surprising improvements and beneficial results.

Last nonseizure load, kg: 80
Weld load, kg: 500
Load wear index: 61.8

EXAMPLE 13

The grease of Example 8 (5% by weight tricalcium phosphate and 5% by weight calcium carbonate) was subjected to the ASTM D4048 Copper Corrosion Test at a temperature of 300° F. for 24 hours. No significant corrosion appeared. The copper test sample remained bright and shiny. The copper strip was rated 1a.

EXAMPLE 14

The grease of Example 12 (3% by weight tricalcium phosphate and about 5% by weight calcium carbonate) was subjected to the ASTM D4048 Copper Corrosion Test at a temperature of 300° F. for 24 hours. The results were similar to Example 13.

The following Examples 15-32 illustrate the surprising and unexpected performance of calcium sulfate and calcium carbonate as an extreme pressure antiwear additive package.

EXAMPLE 15

A grease was prepared in a manner similar to Example 8, except as described below. The polyurea thickener was prepared in a manner similar to Example 1 by reacting 676.28 grams of a fatty amine, sold under the brand name Armeen T by Armak Industries Chemicals Division, 594.92 grams of a diisocyanate, sold under the brand name Mondur CD by Mobay Chemical Corporation, and 536 ml of water. The base oil has a viscosity of 650 SUS at 100° F. and was a mixture of 850 SUS paraffinic, solvent extracted, hydrogenated mineral oil, and hydrogenated solvent extracted, dewaxed mineral oil. corrosion (rust) inhibiting agents, sold under the brand names of Nasul BSN by R. T. Vanderbilt Co. and Lubrizol 5391 by the Lubrizol Corp., were added to the grease for ferrous corrosion protection. Nasul BSN is barium dinonylnaphthylene sulfonate and Lubrizol 5391 is a borate amine. The antioxidants were a mixture of amine-type antioxidants as described above. The grease was stirred and subsequently milled through a Gaulin Homogenizer at a pressure of 7,000 psi until a homogeneous grease was produced. The grease had the following composition:

| Component | % (wt) |
|---|---|
| 850 SUS Oil | 47.58 |
| 350 SUS Oil | 31.20 |
| Polyurea Thickener | 9.50 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |
| Dye | 0.02 |

The grease was tested and had the following performance properties:

| | |
|---|---|
| Worked Penetration, ASTM D217 | 302 |
| Dropping Point, ASTM D2265 | 501° F. |
| Four Ball Wear, ASTM D2266 at 40 kg, 1200 rpm for 1 hr | 0.43 |
| Four Ball EP, ASTM D2596 | |
| last nonseizure load, kg | 80 |
| weld load, kg | 400 |
| load wear index | 63 |
| Bearing Life, ASTM D3336, 350° F. Hours to failure | 433, 626 |

As can be seen, the test results are generally good. The ASTM D3336 bearing life at 350° F., however, is within the typical range previously described as typical for prior art wheel bearing greases.

EXAMPLE 16

The grease of Example 15, was subjected to an oil separation cone test (bleed test), SDM 433 standard test of the Saginaw Steering Gear Division of General Motors. In the test, the grease was place on a 60 mesh nickel screen cone. The cone was heated in an oven for the indicated time at the listed temperature. The percentage decrease in the weight of the grease was measured. The test showed that minimum oil loss occurred even at higher temperatures over a 24 hour time period. The results were as follows:

| time (hr) | temp (°F.) | % oil loss |
|---|---|---|
| 6 | 212 | 2.5 |
| 24 | 212 | 3.9 |
| 24 | 300 | 3.5 |
| 24 | 350 | 2.7 |

EXAMPLE 17

The grease of Example 15 was subjected to an Optimol SRV stepload test under conditions recommended by Optimol Lubricants, Inc. and used by Automotive Manufacturers such as General Motors for lubricant evaluation. This method was also specified by the U.S. Air Force Laboratories Test Procedure of Mar. 6, 1985. In the test, a 10 mm steel ball is oscillated under load increments of 100 Newtons on a lapped steel disc lubricated with the grease being tested until seizure occurs. The grease passed the maximum load of 1,000 Newtons.

EXAMPLE 18

A wheel bearing grease is made without using tricalcium phosphate and calcium carbonate. The grease was prepared from a polyurea base grease similar to that of Example 2. A paraffinic, solvent extracted, dewaxed bright stock was added to increase the base oil viscosity in the final grease. Zinc naphthenate was added as a rust inhibitor. A polymethacrylate polymeric additive sold under the brand name of TC 9355 by Texaco Chemical Company was added to provide an adherent texture. The final grease was milled at 7,000 psi using a Gaulin homogenizer and had the following composition:

| Component | % (wt) |
|---|---|
| 850 SUS Oil | 38.12 |
| Bright Stock | 47.13 |
| Polyurea Thickener | 10.00 |
| TC 9355 | 3.55 |
| Zinc Naphthenate | 1.00 |
| Mixed Aryl Amines | 0.20 |

The grease was tested and had the following performance properties:

| | |
|---|---|
| Worked Penetration, ASTM D217 | 314 |
| Dropping Point, °F., ASTM D2265 | 506 |
| Oil Separations, SDM 433, % | |
| 6 hr, 212° F. | 4.9 |
| 24 hr, 212° F. | 6.0 |
| 24 hr, 300° F. | 6.9 |
| 24 hr, 350° F. | 16.9 |
| Bearing Life, ASTM D3336, 350° F. Hours to failure | 529 |

As can be seen, the grease of Example 18 has inferior oil separation compared to the grease of Example 16. The ASTM D3336 bearing life at 350° F. is within the typical range previously described as typical for prior art wheel bearing greases.

EXAMPLE 19

A wheel bearing grease was made by a procedure similar to that given in Example 15. However, several changes were made in the type and amount of additives added to the polyurea base grease. The grease had the following composition:

| Component | % (wt) |
|---|---|
| 850 SUS Oil | 45.48 |
| 350 SUS Oil | 30.32 |
| Polyurea Thickener | 12.50 |
| Tricalcium Phosphate | 2.00 |
| Calcium Carbonate | 2.00 |
| TC 9355 | 4.00 |

-continued

| Component | % (wt) |
|---|---|
| OLOA 9750 | 1.00 |
| Zinc Naphthenate | 1.00 |
| Nasul BSN | 1.00 |
| Lubrizol 5391 | 0.50 |
| Aryl Amines | 0.20 |

The grease was tested and had the following basic properties:

| | |
|---|---|
| Worked Penetration, ASTM D217 | 318 |
| Dropping Point, ASTM D2265, °F. | 496 |
| Oil Separations, SDM 433, % | |
| 24 hr, 212° F. | 3.4 |
| 24 hr, 300° F. | 2.1 |
| 24 hr, 350° F. | 2.0 |
| Four Ball Wear, ASTM D2266 at 40 kg, 1200 rpm for 1 hr | 0.43 |
| Four Ball EP, ASTM D2596 | |
| last nonseizure load, kg | 80 |
| weld load, kg | 250 |
| load wear index | 42 |
| Optimol SRV Stepload Test, Newtons | 1,000 |
| Corrosion Prevention Properties, ASTM D1743 | Pass |
| Copper Strip Corrosion ASTM D4048, 24 hr, 300° F. | 1A |
| Bearing Life, ASTM D3336, 350° F. Hours to failure | 650 |

As can be seen, the grease of Example 19 has many excellent properties, including low oil separation over a wide temperature range and non-corrosivity to copper at high temperature. However, the ASTM D3336 bearing life at 350° F. is within the typical range previously described as typical for prior art wheel bearing greases.

EXAMPLES 20-21

Two greases were made from a common polyurea base grease similar to that of Example 2. In each case the base grease was stirred and heated in a laboratory grease kettle to 230° F. and then additives were added. The greases were quickly cooled to about 170° F. while adding additional amounts of 850 SUS base oil and 350 SUS base oil similar to those used in the base grease of Example 1. Additives used in the two greases were as follows: tricalcium phosphate; calcium carbonate; Shellvis 40, a styrene-isoprene copolymer available from Shell Chemical Company; Vanlube 848, an octylated diphenylamine antioxidant available from R. T. Vanderbilt Company, Inc.; Nasul BSN HT, a blend of barium dinonylnaphthylene sulfonate and barium tetrapropenylsuccinate rust inhibitors available from King Industries, Inc.; and sodium nitrite. The sodium nitrite had been previously micronized to reduce the mean particle size to less than one micron. Finally, each of the two greases were milled at 7,000 psi using a Gaulin homogenizer. The two greases had the following compositions:

| Test Grease | Ex. 20 | Ex. 21 |
|---|---|---|
| Component, % (wt) | | |
| 850 SUS Oil | 51.35 | 50.78 |
| 350 SUS Oil | 34.24 | 33.86 |
| Polyurea Thickener | 9.50 | 9.50 |
| Nasul BSN HT | 1.50 | 1.50 |
| Vanlube 848 | 1.50 | 1.50 |
| Shellvis 40 | 0.95 | 0.95 |
| Tricalcium Phosphate | 0.48 | 0.48 |

-continued

| Test Grease | Ex. 20 | Ex. 21 |
|---|---|---|
| Calcium Carbonate | 0.48 | 0.48 |
| Sodium Nitrite | — | 0.95 |

Among the tests performed on the two greases was a high temperature outgassing test. In this test an ASTM D942 oxidation bomb is half-filled with the test grease. The bomb is then sealed in the usual fashion and placed in an aluminum block heater. The aluminum block temperature is 350° F. Once the temperature of the bomb has equilibrated with the block, the internal pressure is read from the gauge. After an additional 5 hours, the pressure is again read. The increase is noted as the outgassing at 350° F. The bomb is then removed from the aluminum heating block and allowed to cool to room temperature. The pressure is again read and any residual increase over the initial room temperature pressure (about one atmosphere) is noted.

Test results for the to greases are given below:

| | | |
|---|---|---|
| Worked Penetration, ASTM D217 | 315 | 304 |
| Dropping Point, ASTM D2265, °F. | 520 | 496 |
| Oil Separations, SDM 433, % | | |
| 24 hr, 212° F. | 3.5 | 2.2 |
| 24 hr, 300° F. | 3.5 | 2.0 |
| 24 hr, 350° F. | 4.3 | 17.7 |
| Four Ball Wear, ASTM D2266 at 40 kg, 1200 rpm for 1 hr | 0.49 | 0.50 |
| Four Ball EP, ASTM D2596 | | |
| last nonseizure load, kg | 50 | 63 |
| weld load, kg | 250 | 250 |
| load wear index | 25 | 36 |
| Fretting Wear, ASTM D4170, 24 hr. 0° F. mg loss/race set | 4.1 | 1.1 |
| Bomb Oxidation Stability, ASTM D942 | | |
| Pressure Change After 100 hr, psi | — | 3 |
| Pressure Change After 500 hr, psi | — | 14 |
| Copper Strip Corrosion ASTM D4048, 24 hr, 300° F. | 1A | 1A |
| High Temperature Outgassing Test | | |
| Pressure Increase at 350° F., psi | 9 | 22 |
| Pressure Increase at 75° F., psi | 0 | 6 |
| Bearing Life, ASTM D3336, 350° F. Hours to failure | 518, 781 | 875, 1,100+ |

As can be seen, the grease of Example 21 is somewhat superior to that of Example 20 in Load Wear Index and Fretting Wear Protection at 0° F., but inferior in oil separation at 350° F. However, the most significant difference in the two greases is the superior bearing life of Example 21. The replicate ASTM D3336 test results of the Example 21 grease are superior not only to the grease of Example 20, but also to the greases of Examples 15, 18, and 19. By comparing the compositions of these greases, one can see that the combination of Nasul BSN HT (sulfonate/succinate blend) and sodium nitrite appears to be responsible for the superior high temperature bearing life. This is most surprising and unexpected since both the Nasul BSN HT and sodium nitrite are rust inhibitors and not antioxidants or high temperature stabilizers. While the Nasul BSN HT is supposed to show decreased antagonistic effects on high temperature stability, compared to pure sulfonate rust inhibitors (such as Nasul BSN), it is clear that the Nasul BSN HT is not in and of itself responsible for the superior high temperature bearing life of the Example 21 grease. By comparing the greases of Example 20 and 21, it is apparent that the presence of sodium nitrite was required for the superior bearing life. Without the sodium nitrite, the grease of Example 20 had a high temperature bearing life similar to that of Examples 15, 18, and 19.

It is also seen that the sodium nitrite in the Example 21 grease is responsible for the significantly increased outgassing properties.

Another interesting result is based on a visual inspection of the greases of Examples 20 and 21 compared to greases of previous Examples. The Example 20 and 21 greases had an extremely smooth texture and semi-translucent, glassy appearance not found in the greases of previous Examples.

EXAMPLE 22-23

To further elucidate and confirm the surprising and unexpected synergistic benefits of using both sulfonate/succinate rust inhibitors and sodium nitrite on high temperature bearing life of wheel bearing greases, two additional greases were made in a manner similar to that of Examples 20 and 21. The level of Nasul BSN HT, when used, was increased while the level of sodium nitrite was decreased. The two greases had the following compositions:

| Test Grease | Ex. 21 | Ex. 22 |
|---|---|---|
| Component, % (wt) | | |
| 850 SUS Oil | 49.29 | 50.79 |
| 350 SUS Oil | 32.86 | 33.86 |
| Polyurea Thickener | 11.00 | 11.00 |
| Nasul BSN HT | 2.50 | — |
| Vanlube 848 | 2.50 | 2.50 |
| Tricalcium Phosphate | 0.75 | 0.75 |
| Calcium Carbonate | 0.75 | 0.75 |
| Sodium Nitrite | 0.25 | 0.25 |
| Lubrizol 5391 | 0.10 | 0.10 |

The greases were tested and had the following performance properties:

| | | |
|---|---|---|
| Worked Penetration, ASTM D217 | 306 | 303 |
| Dropping Point, ASTM D2265, °F. | 503 | 505 |
| Oil Separations, SDM 433, % | | |
| 30 hr, 212° F. | 4.1 | 4.1 |
| 24 hr, 300° F. | 2.7 | 6.0 |
| 24 hr, 350° F. | 9.2 | 15.5 |
| Four Ball Wear, ASTM D2266 at 40 kg, 1200 rpm for 1 hr | 0.46 | 0.44 |
| Four Ball EP, ASTM D2596 | | |
| last nonseizure load, kg | 63 | 50 |
| weld load, kg | 200 | 250 |
| load wear index | 29 | 31 |
| Fretting Wear, ASTM D4170, 24 hr. 0° F. mg loss/race set | 2.4 | 6.1 |
| Optimol SRV Stepload Test, 80° C. Maximum Passing Load, Newtons | 900 | 600 |
| Optimol SRV Stepload Test, 150° C. Maximum Passing Load, Newtons | 400 | 300 |
| Copper Strip Corrosion ASTM D4048, 24 hr, 300° F. | 1A | 1A |
| High Temperature Outgassing Test | | |
| Pressure Increase at 350° F., psi | 18 | — |
| Pressure Increase at 75° F., psi | 4 | — |
| Bearing Life, ASTM D3336, 350° F. | 1,049 | 614 |
| Hours to failure | 1,237 | 742 |

A comparison of the greases of Examples 22 and 23 show that the former had superior high temperature oil separation, fretting wear protection at 0° F., and extreme pressure and antiwear (EP/AW) properties as measured by the Optimol SRV stepload tests. The Four Ball EP performance of the Example 22 grease was somewhat less that that of the Example 23 grease. Both greases were non-corrosive at elevated temperatures as indicated by the copper strip corrosion test results. However, the main result was the ASTM D3336 bearing life test results. Once again, the grease with both Nasul BSN HT (sulfonate/succinate blend) and sodium nitrite was much superior to the grease with sodium nitrite and no Nasul BSN HT. This result combined with the results of the greases of Examples 20 and 21 confirm a beneficial synergistic effect on high temperature bearing life when both a sulfonate/succinate additive blend and sodium nitrite are present. Furthermore, by increasing the oil soluble Nasul BSN HT concentration, the level of sodium nitrite can be reduced by nearly 75% and still maintain excellent high temperature bearing life. Reduction of sodium nitrite levels also result in improved high temperature outgassing properties, as seen by comparing the greases of Examples 21 and 22.

The very smooth texture and semi-translucent, glossy appearance observed in the Example 20 and 21 greases was present in the Example 22 grease but not in the Example 23 grease. This establishes that the sulfonate/-succinate blend of Nasul BSN HT is responsible for these desirable properties. By further comparison with the Example 19 grease which contained Nasul BSN (sulfonate with no succinate), it is apparent that the succinate component of the Nasul BSN Ht is responsible for the smooth texture and semi-translucent, glassy appearance.

EXAMPLE 24

The previous two examples indicated that the presence of the Nasul BSN HT improved the Optimol SRV properties imparted by the tricalcium phosphate and calcium carbonate. To further prove this a 1.6 gram portion of Nasul BSN HT was added to a 98.4 gram portion of the Example 23 grease. The resulting grease was heated to about 150° F., well stirred, and finally given three passes through a three roll mill to insure homogeneous composition. The grease was then tested by the Optimol SRV Stepload test at 80° C. and 150° C. Results are as follows:

| SRV Stepload Test, Newtons | |
|---|---|
| 80° C. | 1,000 |
| 150° C. | 500 |

Comparison of these results with those of the Example 23 grease confirm that the presence of both the Nasul BSN HT and the tricalcium phosphate and calcium carbonate impart improved EP/AW properties to the resulting grease compared to a grease which does not contain the Nasul BSN HT. This is most surprising and unexpected since the Nasul BSN HT is not an extreme pressure or antiwear additive and does not have EP/AW properties.

It was also observed that the Example 24 grease had the smooth texture and semi-translucent, glassy appearance lacking in the Example 23 grease from which it was made. This once again confirms the succinate component of the Nasul BSN HT as the cause of this desirable property.

EXAMPLE 25

The grease of Example 21 had improved ASTM D3336 bearing life at 350° F., but had unacceptable outgassing properties, due to the sodium nitrite. s shown in Example 22, the outgassing properties could be made acceptable by reducing the sodium nitrite level in the final grease. In previous greases, the sodium nitrite was added to the polyurea base grease at about 230° F. and the grease was rapidly cooled in the grease kettle. In full scale commercial manufacture, cooling occurs much more slowly, due to surface/volume considerations and heat transfer characteristics of commercial grease kettles. Another grease similar to that of Example 21 was made. However, the polyurea base grease was heated to 300° F. and the tricalcium phosphate, calcium carbonate, and sodium nitrite were added. The base grease was then blanketed with nitrogen and stirred for four hours at 300° F. This was done to approximate the time/temperature conditions which would be experienced in large-scale commercial manufacture if the sodium nitrite was added at 300° F. to 350° F. while cooling the polyurea base grease. The tricalcium phosphate and calcium carbonate were also added for the sake of convenience. After the four hours, the additized base grease was cyclically milled with a rotating knife mill and cooled to about 200° F. The remaining additives were added, the final grease cooled to 170° F., and milled at 7,000 psi through a Gaulin homogenizer. The grease had the following composition:

| Component | % (wt) |
|---|---|
| 850 SUS Oil | 50.22 |
| 350 SUS Oil | 33.48 |
| Polyurea Thickener | 9.00 |
| Vanlube 848 | 2.00 |
| Nasul BSN HT | 1.60 |
| Sodium Nitrite | 1.00 |
| Shellvis 40 | 1.00 |
| Tricalcium Phosphate | 0.80 |
| Calcium Carbonate | 0.80 |
| Lubrizol 5391 | 0.10 |

The grease was tested and had the following basic properties:

| | |
|---|---|
| Worked Penetration, ASTM D217 | 327 |
| Oil Separations, SDM 433, % | |
| 30 hr, 212° F. | 3.2 |
| 24 hr, 300° F. | 1.7 |
| 24 hr, 350° F. | 9.9 |
| Four Ball Wear, ASTM D2266 at 40 kg, 1200 rpm for 1 hr | 0.51 |
| Four Ball EP, ASTM D2596 | |
| last nonseizure load, kg | 80 |
| weld load, kg | 315 |
| load wear index | 40 |
| Fretting Wear, ASTM D4170, 24 hr. 0° F. mg loss/race set | 5.5 |
| Copper Strip Corrosion ASTM D4048, 24 hr, 300° F. | 1A |
| Optimol SRV Stepload Test, 80° C. Maximum Passing Load, Newtons | 400 |
| Optimol SRV Stepload Test, 150° C. Maximum Passing Load, Newtons | 400 |
| High Temperature Outgassing Test | |
| Pressure Increase at 350° F., psi | 15 |
| Pressure Increase at 75° F., psi | 04 |
| Bearing Life, ASTM D3336, 350° F. Hours to failure | 1,104+, 1,100+ |

Once again, excellent high temperature bearing life is obtained. However, the high temperature outgassing properties have been improved to a satisfactory level compared to the Example 21 grease. Since the level of sodium nitrite in both the Example 21 and 25 greases is equivalent, the improved outgassing properties of the Example 25 grease must be due to the temperature/time treatment of the sodium nitrite in the grease during its manufacture.

EXAMPLES 26–31

A series of six automotive wheel bearing greases were made using a procedure similar to that described in the previous Example 25. The sodium nitrite, tricalcium phosphate, and calcium carbonate were added to the polyurea base grease at 300° F. and the additized base grease was stirred under nitrogen blanket at 300° F. for four hours. In addition to additives used in previous examples, other additives used were: Iraganox L-57, an alkylated diphenylamine antioxidant available from Ciba-Geigy Corporation; Additin 35, an alkylated diphenylamine antioxidant available from Rhein-Chemie Corporation; Vanlube 849, an alkylated diphenylamine antioxidant available from R. T. Vanderbilt Company, Inc; Nasul CA HT, a blend of calcium dinonylnaphthylene sulfonate and calcium tetrapropenylsuccinate rust inhibitors available from King Industries, Inc.; and Nasul MG HT, a blend of magnesium dinonylnaphthylene sulfonate and magnesium tetrapropenylsuccinate rust inhibitors available from King Industries, Inc. The greases were then finished in the same way described in Example 25. The six greases had the following compositions and performance properties.

| | Ex. 26 | Ex. 27 | Ex. 28 |
|---|---|---|---|
| Test Grease | | | |
| Component, % (wt) | | | |
| 850 SUS Oil | 49.96 | 49.96 | 49.96 |
| 350 SUS Oil | 33.31 | 33.31 | 33.31 |
| Polyurea Thickener | 10.00 | 10.00 | 10.00 |
| Vanlube 848 | 2.22 | — | — |
| Vanlube 849 | — | 2.22 | — |
| Irganox L-57 | — | — | 2.22 |
| Nasul BSN HT | 1.78 | 1.78 | 1.78 |
| Tricalcium Phosphate | 0.89 | 0.89 | 0.89 |
| Calcium Carbonate | 0.89 | 0.89 | 0.89 |
| Shellvis 40 | 0.56 | 0.56 | 0.56 |
| Sodium Nitrite | 0.28 | 0.28 | 0.28 |
| Lubrizol 5391 | 0.11 | 0.11 | 0.11 |
| Test Results | | | |
| Worked Penetration, ASTM D217 | 312 | 310 | 304 |
| Dropping Point, ASTM D2265, °F. | 516 | 531 | 501 |
| Oil Separations, SDM 433, % | | | |
| 30 hr, 212° F. | 3.6 | 4.0 | 3.8 |
| 24 hr, 300° F. | 2.4 | 1.9 | 2.0 |
| 24 hr, 350° F. | 7.9 | 6.4 | 6.4 |
| Oil Separation During Storage, ASTM D1742, % | 0.68 | 0.87 | 0.50 |
| Four Ball Wear, ASTM D2266 at 40 kg, 1200 rpm for 1 hr | 0.68 | 0.87 | 0.50 |
| Four Ball EP, ASTM D2596 | | | |
| last nonseizure load, kg | 63 | 63 | 80 |
| weld load, kg | 250 | 250 | 250 |
| load wear index | 31 | 31 | 36 |
| Optimol SRV Stepload Test, 80° C. Maximum Passing Load, Newtons | 400 | 600 | 800 |
| Optimol SRV Stepload Test, 150° C. Maximum Passing Load, Newtons | 700 | 700 | 700 |
| Fretting Wear, ASTM D4170, 24 hr. 0° F. mg loss/race set | 6.7 | 10.5 | 3.4 |
| Corrosion Prevention, ASTM D1743 Synthetic Sea Water Procedure (3%) | Pass | Pass | Pass |
| Copper Strip Corrosion, | — | — | 1A |

-continued

| | | | |
|---|---|---|---|
| ASTM D4048, 24 hr, 300° F. High Temperature Outgassing Test | | | |
| Pressure Increase at 350° F., psi | 14 | 14 | 14 |
| Pressure Increase at 75° F., psi | 4 | 4 | 4 |
| Bearing Life, ASTM D3336, | 1,050 | 1,046 | 1,065 |
| 350° F. Hours to failure | 801 | 1,513+ | 1,002 |

| | Ex. 29 | Ex. 30 | Ex. 31 |
|---|---|---|---|
| Test Grease | | | |
| Component, % (wt) | | | |
| 850 SUS Oil | 49.96 | 49.96 | 49.96 |
| 350 SUS Oil | 33.31 | 33.31 | 33.31 |
| Polyurea Thickener | 10.00 | 10.00 | 10.00 |
| Additin 35 | 2.22 | — | — |
| Irganox L-57 | — | 2.22 | 2.22 |
| Nasul BSN HT | 1.78 | — | — |
| Nasul MG HT | — | 1.78 | — |
| Nasul CA HT | — | — | 1.78 |
| Tricalcium Phosphate | 0.89 | 0.89 | 0.89 |
| Calcium Carbonate | 0.89 | 0.89 | 0.89 |
| Shellvis 40 | 0.56 | 0.56 | 0.56 |
| Sodium Nitrite | 0.28 | 0.28 | 0.28 |
| Lubrizol 5391 | 0.11 | 0.11 | 0.11 |
| Test Results | | | |
| Worked Penetration, ASTM D217 | 312 | 337 | 323 |
| Dropping Point, ASTM D2265, °F. | 497 | 511 | 502 |
| Oil Separations, SDM 433, % | | | |
| 30 hr, 212° F. | 3.7 | 6.0 | 3.7 |
| 24 hr, 300° F. | 2.1 | 4.2 | 3.6 |
| 24 hr, 350° F. | 7.4 | 9.9 | 8.9 |
| Oil Separation During Storage, ASTM D1742, % | 0.35 | — | — |
| Four Ball Wear, ASTM D2266 at 40 kg, 1200 rpm for 1 hr | 0.52 | 0.48 | 0.50 |
| Four Ball EP, ASTM D2596 | | | |
| last nonseizure load, kg | 63 | 50 | 63 |
| weld load, kg | 315 | 250 | 250 |
| load wear index | 33 | 30 | 30 |
| Optimol SRV Stepload Test, 80° C. Maximum Passing Load, Newtons | 800 | 500 | 500 |
| Optimol SRV Stepload Test, 150° C. Maximum Passing Load, Newtons | 800 | 300 | 400 |
| Fretting Wear, ASTM D4170, 24 hr, 0° F. mg loss/race set | 3.6 | 3.4 | 3.7 |
| Corrosion Prevention, ASTM D1743 Synthetic Sea Water Procedure (3%) | Pass | Pass | Pass |
| High Temperature Outgassing Test | | | |
| Pressure Increase at 350° F., psi | — | 17 | 16 |
| Pressure Increase at 75° F., psi | — | 5 | 5 |
| Bearing Life, ASTM D3336, | 1,236 | 1,640 | 1,594 |
| 350° F. Hours to failure | 1,129 | 1,464 | 1,864 |

Results are excellent for all six greases. As shown by the ASTM D3336 bearing life test results, the extent of the synergism between sulfonate/succinate additive and sodium nitrite depends on the cation present in the sulfonate/succinate additive. The magnesium additive (Nasul MG HT) and the calcium additive (Nasul CA HT) give superior ASTM D3336 bearing life at 350° F. compared to the barium additive (Nasul HT). Most surprisingly, both the Nasul MG HT and Nasul CA HT greases of Examples 30 and 31, respectively, had even smoother textures and even more semi-translucent, glassy appearances than did the greases which contained the Nasul BSN HT. This indicates that the extent of texture benefits also depends on the cation present in the sulfonate/succinate additive.

Among the many advantages of the novel wheel bearing grease are:

1. High performance as a wheel bearing grease.
2. Excellent performance in sealed-for-life automotive wheel bearings.
3. Promoting outstanding high temperature bearing life to an extent superior to prior art automotive wheel bearing greases.
4. High dropping point.
5. Extremely smooth texture and a semi-translucent, glassy appearance conducive to good acoustical properties.
6. Excellent protection against ferrous corrosion (rust) even when exposed to salt water.
7. Superior non-corrosivity to copper, iron and steel at prolonged high temperatures.
8. Good extreme pressure and wear resistance properties.
9. Excellent low temperature fretting wear protection.
10. Oxidatively and thermally stable at high temperatures and at lower temperatures.
11. Acceptably low outgassing properties at high temperatures.
12. Remarkable compatibility and protection of elastomers and seals.
13. Excellent oil separation qualities, even at high temperatures.
14. Nontoxic.
15. Safe
16. Environmentally acceptable
17. Economical Although embodiments of this invention have been described, it is to be understood that various modifications and substitutions, as well as rearrangements of process steps, can be made by those skilled in the art without departing from the novel spirit and scope of this invention.

What is claimed is:

1. A wheel bearing grease, comprising:

from about 20% to about 95% of a base oil;

a thickener;

a succinate-containing texture improving additive for imparting a substantially smooth texture to said grease;

a carbonate selected from the group consisting of a carbonate of a Group 1a alkali metal and a carbonate of a Group 2a alkaline earth metal; and a phosphate selected from the group consisting of a phosphate of a Group 1a alkali metal and a phosphate of a Group 2a alkaline earth metal.

2. A wheel bearing grease in accordance with claim 1 including a sulfonate-containing additive.

3. A wheel bearing grease in accordance with claim 2 wherein said sulfonate-containing additive comprises a metal sulfonate salt selected from the group consisting of a sulfonate of a Group 1a alkali metal, a sulfonate of a Group 2a alkaline earth metal, and a sulfonate of a transition metal.

4. A wheel bearing grease in accordance with claim 1 wherein said succinate-containing texture improving additive comprises a metal succinate salt selected from the group consisting of a succinate of a Group 1a alkali metal, a succinate of a Group 2a alkaline earth metal, and a succinate of a transition metal.

5. A wheel bearing grease in accordance with claim 1 including a high temperature bearing life additive comprising sodium nitrite.

6. A wheel bearing grease in accordance with claim 1 wherein said thickener comprises at least one member selected from the group consisting of polyurea, biurea and triurea.

7. A wheel bearing grease in accordance with claim 1 including an antioxidant selected from the group consisting of an amine antioxidant and a phenolic antioxidant.

8. A wheel bearing grease, comprising:

from about 20% to about 95% of a base oil;

a thickener;

phosphate and carbonate extreme pressure wear-resistant additives;

oil soluble or oil disperible metal salts of sulfonic acids and succinic acids;

said sulfonic acids comprising at least one member selected from the group consisting of petroleum sulfonic acid, alkylbenzene sulfonic acid, alkylnapthylene sulfonic acid, anthracene-containing sulfonic acid, and phenalene-containing sulfonic acid; and said succinic acid comprising an alkylated succinic acid.

9. A wheel bearing grease in accordance with claim 8 wherein said sulfonic acid comprises dinonylnaphthylene sulfonic acid.

10. A wheel bearing grease in accordance with claim 8 wherein said alkylated succinic acid comprises a monoalkylated succinic acid with an alkyl group having at least two carbons.

11. A wheel bearing grease in accordance with claim 8 wherein said alkylated succinic acid comprises tetrapropenylsuccinic acid.

12. A wheel bearing grease, comprising by weight:

from about 20% to about 95% base oil;

from about 0.1% to about 30% polyurea thickener;

from about 0.01 to about 5% sodium nitrite for enhancing high temperature bearing life;

from about 0.1% to about 10% amine antioxidant;

from about 0.02% to about 10% extreme pressure wear-resistant additives comprising a carbonate and a phosphate;

from about 0.1% to about 10% rust-inhibiting texture improving additives comprising a metal succinate salt and a metal sulfonate salt, said metal succinate salt and said metal sulfonate salting cooperating with said carbonate and said phosphate for further enhancing extreme pressure wear-resistance of said grease;

said carbonate, said phosphate, said metal succinate salt, and said metal sulfonate salt, each comprising at least one member selected from the group consisting of a Group 1a alkali metal and a Group 2a alkaline earth metal;

said alkali metal being selected from the group consisting of lithium, sodium, potassium, rubidium, cesium, and francium; and said alkaline earth metal being selected from the group consisting of beryllium, magnesium, calcium, strontium, and barium.

13. A wheel bearing grease in accordance with claim 12 including less than 10% by weight polymer and said base oil comprises an oil selected from the group consisting of naphthalenic oil, paraffinic oil, aromatic oil and a synthetic oil, said synthetic oil comprising at least one member selected from the group consisting of polyalphaolefin, polyolester, diester, polyalkyl ether, polyaryl ether, and silicone polymer fluids.

14. A wheel bearing grease in accordance with claim 12 wherein said grease comprises by weight:

from about 45% to about 85% base oil;

from about 4% to about 20% polyurea thickener;

from about 0.05% to about 2% sodium nitrite;

from about 0.5% to about 5% amine antioxidant;

from about 0.2% to about 5% extreme pressure wear-resistant additives comprising from about 0.1% to about 2.5% calcium carbonate and from about 0.1% to about 2.5% tricalcium phosphate; and from about 0.5% to about 5% of said rust-inhibiting texture improving additives comprising a metal succinate salt selected from a Group 2a alkaline earth metal and a metal sulfonate salt selected from a Group 2a alkaline earth metal; and less than 5% polymers.

15. A wheel bearing grease in accordance with claim 14 wherein said grease comprises by weight:

at least 65% base oil;

from about 8% to about 14% polyurea thickener;

from about 0.1% to about 1% sodium nitrite;

from about 1% to about 2.5% amine antioxidant;

from about 1% to about 2% extreme pressure wear-resistant additives comprising from about 0.5% to about 1% calcium carbonate and from about 0.5% to about 1% tricalcium phosphate;

from about 1% to about 2.5% rust-inhibiting texture improving additives comprising a metal succinate salt and a metal sulfonate salt, said metal succinate salt and said metal sulfonate salt each comprising a member selected from the group consisting of calcium, magnesium, barium and zinc; and less than 1% polymers.

16. A wheel bearing grease in accordance with claim 15 wherein said base oil comprises a mixture of two refined, solvent-extracted hydrogenated dewaxed base oils, comprising by weight: 60% 850 SUS oil and 40% 350 SUS oil.

17. A wheel bearing grease in accordance with claim 14 including a boron-containing additive to inhibit oil separation.

18. A wheel bearing grease in accordance with claim 17 wherein said boron-containing additive comprises at least one member selected from the group consisting of a borate of a Group 1a alkali metal, a borate of a Group 2a alkaline earth metal, and a borate of a transition metal.

19. A wheel bearing grease in accordance with claim 17 wherein said boron-containing additive is selected from the group consisting of borated amine and potassium triborate.

* * * * *

UNITED STATES PATENT AND TRADEMARK OFFICE

CERTIFICATE OF CORRECTION

PATENT NO. : 5,207,935

DATED : May 4, 1993

INVENTOR(S) : John A. Waynick

It is certified that error appears in the above-indentified patent and that said Letters Patent is hereby corrected as shown below:

Col. 3, line 27, "homes road grading" should read --homes, road grading--.

Col. 8, line 52, "35% by weight" should read --40% by weight--.

Col. 23, line 54, "was place on" should read --was placed on--.

Col. 33, line 14, "oil disperible" should read --oil dispersible--.

Signed and Sealed this

Twenty-second Day of February, 1994

*Attest:*

*Attesting Officer*

BRUCE LEHMAN

*Commissioner of Patents and Trademarks*